United States Patent [19]

Peters

[11] 4,105,877

[45] Aug. 8, 1978

[54] ELECTROSTATIC LOUDSPEAKER HAVING ELASTIC DIAPHRAGM SPACER ELEMENTS CURED IN SITU

[76] Inventor: Bernardus Gradus Peters, 428 Houtsnijdershorst, Apeldoorn, Netherlands

[21] Appl. No.: 790,579

[22] Filed: Apr. 25, 1977

[51] Int. Cl.[2] ..... H04R 19/02
[52] U.S. Cl. ..... 179/111 R
[58] Field of Search ..... 179/111 R

[56] References Cited

U.S. PATENT DOCUMENTS 1,975,801 10/1934 Rieber ..... 179/111 R

FOREIGN PATENT DOCUMENTS 566,697 9/1975 Switzerland ..... 179/111 R
838,024 6/1960 United Kingdom ..... 179/111 R
431,758 4/1934 United Kingdom ..... 179/111 R

*Primary Examiner*—George G. Stellar
*Attorney, Agent, or Firm*—Walter Becker

[57] ABSTRACT

An electrostatic loudspeaker including a diaphragm having two opposite sides and supported by a frame with rigid walls respectively spaced from the two opposite sides of the diaphragm and provided with perforations to permit air to pass therethrough. Electrodes are respectively mounted on the walls. In the space between the diaphragm and at least one of the walls or another rigid part between the walls there is provided an elastic support for the diaphragm.

4 Claims, 3 Drawing Figures

ELECTROSTATIC LOUDSPEAKER HAVING ELASTIC DIAPHRAGM SPACER ELEMENTS CURED IN SITU

This invention relates to an electrostatic loudspeaker, wherein a diaphragm is mounted in a frame with rigid walls spaced from both sides of the diaphragm and allowing sound waves to pass and carrying the electrodes, the walls being mounted on the frame.

Because of the small mass of the diaphragm, loudspeakers of this general type are capable of reproducing sounds with very little distortion or coloration.

It is an object of this invention to provide an electrostatic loudspeaker, in which higher voltage may be used without the diaphragm becoming unstable and contacting one of the electrodes.

This object and other objects and advantages of the invention will appear more clearly from the following specification in connection with the accompanying drawing in which.

The electrostatic loudspeaker according to this invention which has its diaphragm carried in a frame with rigid walls spaced from both sides of the diaphragm and allowing passages of air, has said walls bearing electrodes while the walls are mounted in the frame. An elastic mass is provided in a space between the diaphragm and at least one wall or another rigid part, the mass bearing against both the diaphragm and the rigid wall or part.

It is of advantage for the elastic mass, when in the central position, not to subject the diaphragm to prestressing. The elastic mass may be introduced by allowing a viscous or kneadable putty-like mass, of a substance capable of hardening into an elastic mass, to flow into an opening in the rigid wall to achieve this. The deformable or flowable condition of the mass thus introd ced does not exert pressure on the diaphragm.

The substance selected for the mass to be introduced may be one which, after hardening, will adhere to the diaphragm. While various substances of this type may be used, elastic substances such as silicon pastes described in U.S. Pat. Nos. 3,109,013, 3,035,016, and 3,077,465 have prooved particularly advantageous in connection with the present invention.

Figure 1:
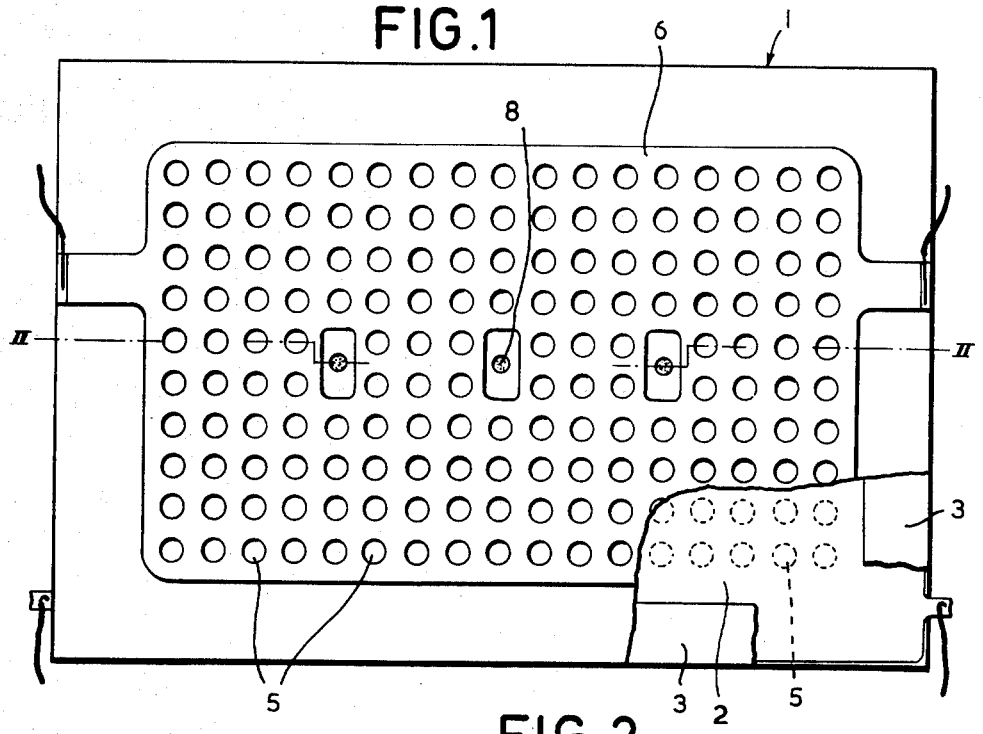
FIG. 1 shows a plan view of a loudspeaker.
Figure 2:
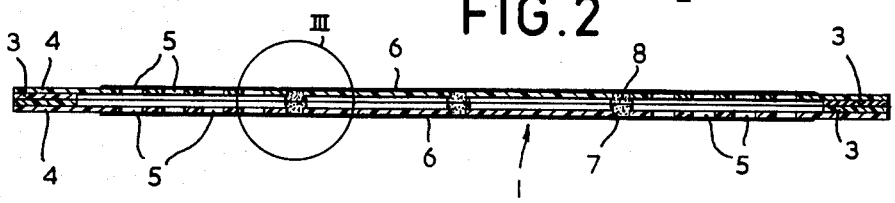
FIG. 2 shows a section along the line II—II of FIG. 1.
Figure 3:
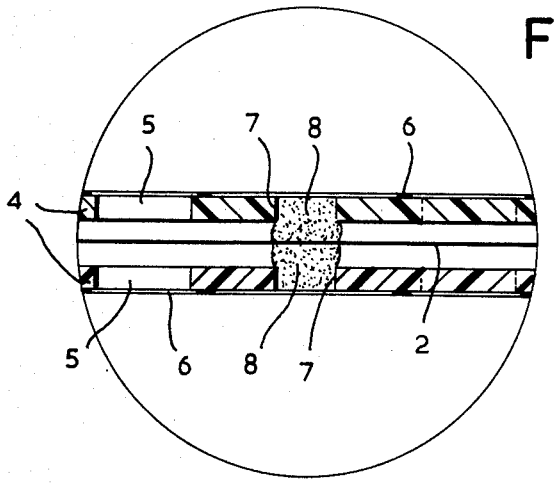
FIG. 3 shows that part of the section of FIG. 2 which is located within the circle III, but on a larger scale then that of FIG. 1, while showing how an elastic mass is arranged.

Referring now to the drawing in detail, the loudspeaker 1 has a diaphragm 2 clamped in a frame 3 between two rigid walls 4 having apertures 5. Electrodes 6 are mounted on the walls 4. Each wall 4 has apertures 7 in a central zone which may have a different shape or size from the sound apertures 5. An elastic support 8 for the diaphragm 2 is provided in the apertures 7 (see FIG. 3) by introduction of a viscous or kneadable mass which hardens to form a solid self-supporting but elastic substance, and may be of the above mentioned type.

It has been found that a considerably higher voltage can be impressed on the diaphragm of the electrostatic loudspeaker according to the invention than with heretofore known loudspeakers, without detracting from the stability of the diaphragm or from the accuracy with which it is centered. In particular, this system improves efficiency and impulse reproduction.

An electrostatic loudspeaker clamped to a frame having an inside width of 13 × 8 cm will tolerate an impressed voltage of at least 5 kV, providing excellent sound reproduction from 240 to 20000 Hz, with only a very small spacing between diaphragm and electrode.

It is, of course, to be understood that the present invention is, by no means, limited to the specific showing in the drawing, but also comprises any modifications within the scope of the appended claims.

What I claim is:

1. An electrostatic loudspeaker which includes in combination: a diaphragm having two opposite sides, a frame supporting said diaphram and provided with substantially rigid walls respectively arranged on opposite sides of and spaced from said two opposite sides of said diaphragm and provided with means for permitting air to pass therethrough, electrodes respectively mounted on said walls, and means for elastically supporting said diaphragm comprising an elastic mass interconnecting at least one of said walls and said diaphragm, wherein said elastic mass adheres to said diaphragm and does not exert pressure thereon, said elastic mass being in a state prior to the elastic mass state when located in position initially.

2. A loudspeaker in combination according to claim 1, in which said elastic mass is a hardened mass hardened from a putty-like mass.

3. A loudspeaker in combination according to claim 1, in which said elastic mass extends from said walls on opposite sides of said diaphragm into the latter.

4. A loudspeaker in combination according to claim 1, in which said elastic mass extends into at least some of the perforations in at least one of said walls.

* * * * *